United States Patent [19]

Eschmann

[11] Patent Number: 4,563,864

[45] Date of Patent: Jan. 14, 1986

[54] APPARATUS FOR FILLING SACKS

[75] Inventor: Heinz Eschmann, Lengerich of Westphalia, Fed. Rep. of Germany

[73] Assignee: Windmoller & Holscher, Lengerich, Fed. Rep. of Germany

[21] Appl. No.: 560,514

[22] Filed: Dec. 12, 1983

[30] Foreign Application Priority Data

Dec. 13, 1982 [DE] Fed. Rep. of Germany ..... 3246089

[51] Int. Cl.[4] ..... B65B 43/30

[52] U.S. Cl. ..... 53/570; 53/384; 53/571; 141/10; 141/114

[58] Field of Search ..... 53/384, 570, 571; 141/10, 114, 315, 314, 317

[56] References Cited

U.S. PATENT DOCUMENTS

| | | | |
|---|---|---|---|
| 2,973,612 | 3/1961 | McGowan | 53/384 |
| 3,807,193 | 4/1974 | McKenney et al. | 53/384 |
| 4,182,094 | 1/1980 | Lieder | 53/571 |
| 4,300,600 | 11/1981 | Tetenborg et al. | 141/10 |
| 4,309,861 | 1/1982 | Karpisek | 53/570 |
| 4,432,186 | 2/1984 | McGregor | 141/114 |

FOREIGN PATENT DOCUMENTS 2116090 10/1972 Fed. Rep. of Germany .

*Primary Examiner*—John Sipos
*Assistant Examiner*—Donald R. Studebaker
*Attorney, Agent, or Firm*—Fleit, Jacobson, Cohn & Price

[57] ABSTRACT

In a sack filling machine, pivotable flaps are in a V formation when in a sack-receiving position and they are provided with means for clamping the mouth of each sack to be filled. In the receiving position, one of the flaps completely covers the outlet of a filling tube by sealingly abutting a bevelled edge on the tube.

8 Claims, 6 Drawing Figures

APPARATUS FOR FILLING SACKS

The invention relates to an apparatus for filling sacks comprising flaps which are pivotable on a fixed frame about parallel longitudinal axes, are provided near their lower edges with clamping means for clamping the mouth edges of sacks to be filled and between which there is arranged the lower zone of a vertical conduit for supplying the filling material, which conduit is closed at the lower end upon pivoting of the flaps to a substantially V-shaped receiving position for a new sack.

In an apparatus of this kind known from DE-AS No. 21 16 090, the conduit supplying the filling material is a flexible hose which, after filling and removal of the filled sack from the clamping means, is squeezed or closed by the flaps swung to their inner position. In this way, whilst the next sack to be filled is clamped, its filling can already be held ready in the filling tube so that, immediately after the sack has been clamped, the filling material can be introduced therein from a reduced height. The use of a flexible hose can, however, create problems because it is movable in an uncontrolled manner, can become jammed in the flaps and be damaged thereby, whereafter proper closing of the hose is no longer certain.

It is therefore an object of the invention to improve an apparatus of the aforementioned kind so that it has a long life and enables the conduit for the filling material to be securely closed at its lower end.

According to the invention, this object is attained in that the conduit is a filling tube of rigid material, that one of the flaps is longer and in its receiving position completely covers the opening cross-section of the filling tube, and that the lower edge of the filling tube is bevelled and lies substantially in the plane in which the longer flap is disposed in its receiving position so that the latter sealingly abuts the bevelled edge in the receiving position. The apparatus of the invention ensures a secure seal of the filling tube in that one of the flaps simultaneously constitutes a closure flap which, in the receiving position, is sealingly pressed against the lower bevelled edge of the filling tube. This construction ensures that, while a new sack is being clamped to the flaps, no filling material reaches the space between the flaps that is usually not so tightly closed that filling material could leave same. Since in the apparatus of the invention the flaps in their V-shaped receiving position are oblique as a whole, clamping of the new sacks is also simplified and they can, for example, be held ready in a stack on a table next to the filling apparatus.

The frame surrounding the filling tube is desirably tubular or funnel-shaped, the flaps hinged thereto being provided with at least partially overlapping flanged lateral sheet metal plates so that an annular passage is formed between the filling tube and the frame as well as the flaps from which dust of filling material can be sucked.

Other advantageous features of the invention will be apparent from the detailed description of an illustrated embodiment.

One example of the invention will now be described in more detail with reference to the drawing, wherein.

Figure 1:
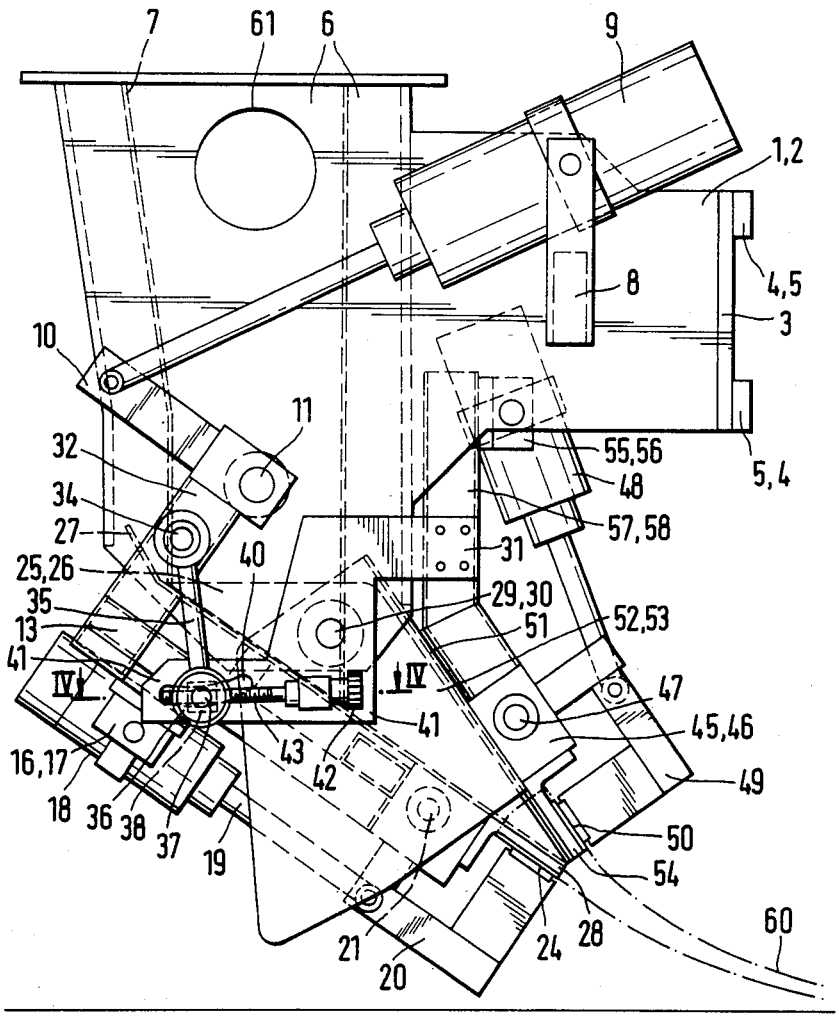
FIG. 1 is a side elevation of the filling apparatus with the flaps swung to their receiving position and a new sack just clamped into place.

The funnel 6 forming the supporting frame for the closure flaps 27, 51 pivoted thereto is secured to parallel supporting plates 1, 2 interconnected at their ends by a web 3 and welded to beams or consoles 4, 5 of the stand (not shown). The funnel 6 carried by the supporting plates 1, 2 surrounds a filling tube or a funnel 7 which is smaller in cross-section and secured in the stand in a manner which is not shown in detail.

Between the limbs of a U-shaped retaining frame welded to the supporting plate 2, the cylinder of a piston-cylinder unit 9 is pivotably mounted. The piston rod of this piston-cylinder unit 9 is hinged to a lever 10 which is rotatably mounted on a pin 11 welded to the funnel 6. At the side wall of the funnel 6 opposite to the pin 11, there is a further pin 12. Both pins 11, 12 carry a pivotable frame member 13 shown in perspective in FIG. 5. Pivoting of the frame member 13 takes place by way of the piston-cylinder unit 9 with the aid of the two-armed lever 10 of which one arm is part of the frame member 13 and is at right-angles to the arm to which the piston rod of the piston-cylinder unit 9 is hinged.

Figure 5:
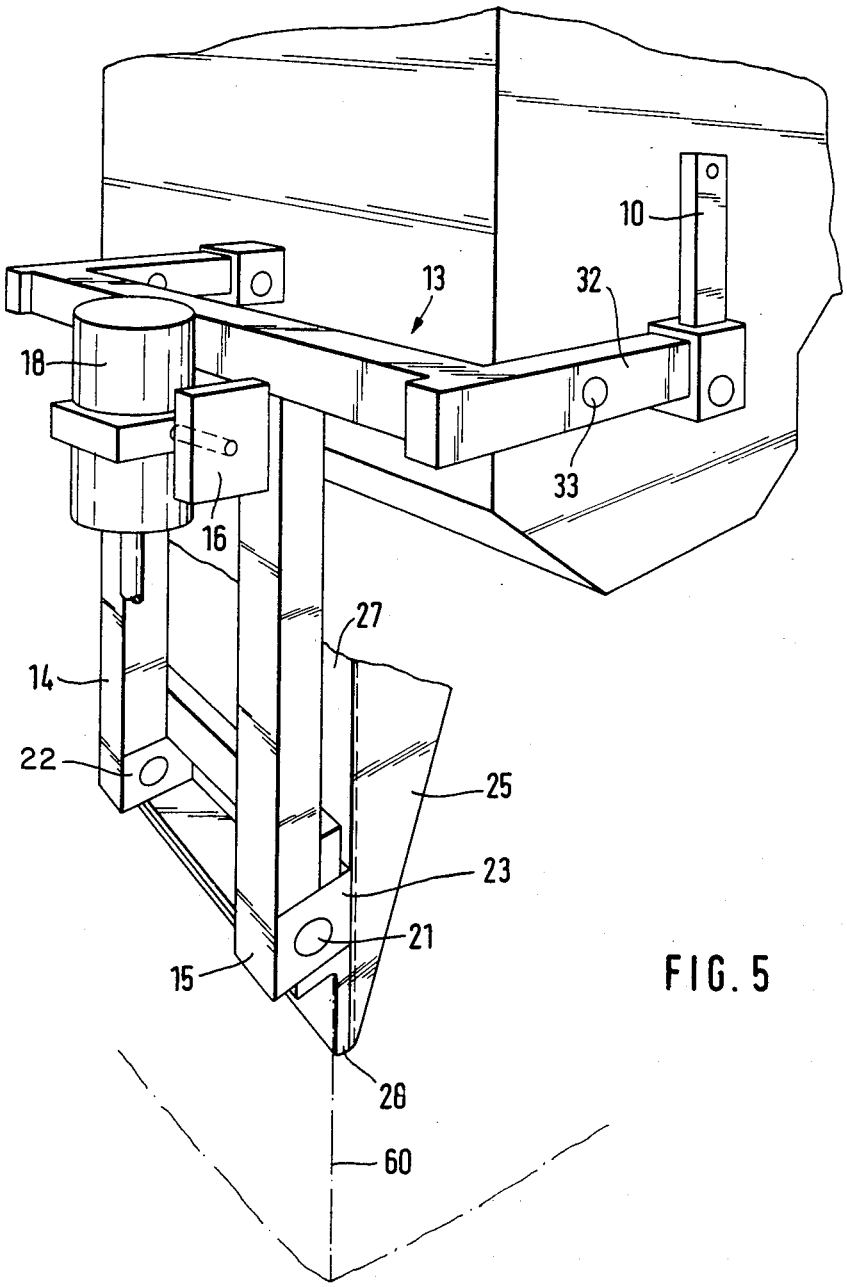
FIG. 5 is a perspective view of the flap closing the filling tube and its associated mounting and FIG. 6 is a perspective view of the counter-flap.

The two profiles 14 and 15 of the frame member 13 extending vertically in FIG. 5 carry plummer blocks 16 and 17 between which a further piston-cylinder unit 18 is pivoted. The piston rod 19 of this unit engages an angular lever 20 which can be pivoted about the pin 21 secured to the flap 27. The pin 21 is mounted in two projecting supporting members 22 and 23 secured to the lower ends of the profiles 14 and 15. With the piston rod 19 extended, the pressure face 24 of the tensioning lever 20 is pressed from the outside against the lower region of closure flap 27 provided with side cheeks 25 and 26. This closure flap 27 is rigidly welded to the end faces of the supporting members 22 and 23. The regions of the closure flap 27 against which the pressure face 24 is pressed are reinforced by an angle 28 of which one limb is fixed to the supporting members 22 and 23 and the other limb to the lower zone of the closure flap 27.

Figure 6:
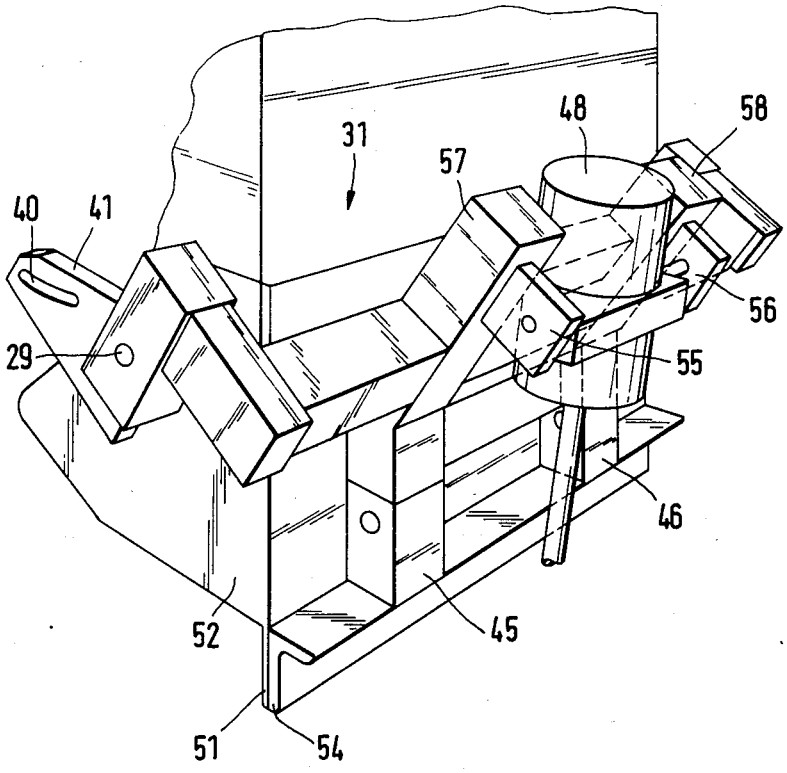

Below the pins 11 and 12 and laterally offset therefrom there are two further pins 29 and 30 welded to the funnel. A further frame member 31 is pivoted to these pins 29 and 30, the construction of the frame member 31 being evident from the perspective view of FIG. 6. The pivotal motion of this frame member 31 is likewise effected by the piston-cylinder unit 9. For this purpose, the arm 32 of frame member 13 has a bore 33 at a spacing from the pivotal shaft 11, 12 for receiving a pin 34. Mounted at this pin 34, there is a tension rod 35 carrying a ball bearing 36 at the end remote from the pin 34. This ball bearing 36 is secured on the pin 37 of an adjusting nut 38, which is provided with a further pin 39 guided in an elongate hole 40 of an arm 41, the arm 41 being part of the frame member 31. For the purpose of adjusting the pin 39 in the elongate hole 40, the spindle 43 is turned by the hand wheel 42, this spindle being in turn rotatably connected to the arm 41 but axially fixed thereto by way of a holder 44. The curvature of the elongate hole 40 is selected so that the pin 39 in the FIG.

1 position of the frame member 13 can be adjusted to every position within the elongate hole by means of the hand wheel 42 without thereby changing the relative position between the frame member 13 and frame member 31. As in the case of the frame member 13, this frame member 31 likewise carries two supporting members 45 and 46 in which a pin 47 is mounted. By way of a piston-cylinder unit 48, a clamping lever 49 can be pivoted about this pin 47, namely in a manner such that, with the piston rod of the unit 48 extended, the pressure face 50 of the clamping lever 49 is pressed against the lower region of further closure flap 51. As in the case of the closure flap 27, the closure flap 51 likewise has two side cheeks 52 and 53 and, in the region in which the pressure face presses against the closure flap 51, is likewise reinforced by an angle 54 connected to the lower zone of the closure flap 51 and to the supporting members 45 and 46. The piston cylinder unit 48 is pivotable in two consoles 55 and 56 which, in turn, are connected to the two profiles 57 and 58 of frame member 31.

In the FIG. 1 representation, the filling tube 7, which is bevelled at its outlet zone, is kept closed by the closure flap 27. In this position, the lower zone of the closure flap 27 reinforced by an angle 28 lies against the lower zone of flap 51 reinforced by an angle 54. As is also shown in FIG. 1, a sack 60 is placed over the lower flap regions and pressed thereagainst from the outside by the pressure faces 24 and 50. In this position, i.e. in the closed position of the inner funnel 7, the latter is filled with filling material. Thereafter, the closure flap 27 and the closure flap 51 are pivoted to the FIG. 2 position by retracting the piston of the piston-cylinder unit 9. Dust created during filling of the sack can be sucked off through the annular space formed between the filling tube 7 and the outer funnel 6 and through a conduit adjoining the aperture 61. In this position, the side cheeks 25 and 26 of closure flap 27 overlap the side cheeks 52 and 53 of flap 51 so that as tight a seal as possible is achieved with respect to the sack 60 and the dust created during filling can be effectively sucked away. After filling a sack, the clamping levers 20 and 49 are swung away by the piston-cylinder units 18 and 48 in such a manner that the pressure faces 24 and 50 are released from the sack wall and free the sack 60. The filled sack 60 then slides down the reinforcing angles 28 and 54, for example onto a conveyor belt (not shown) by which it can then be taken away.

Figure 2:
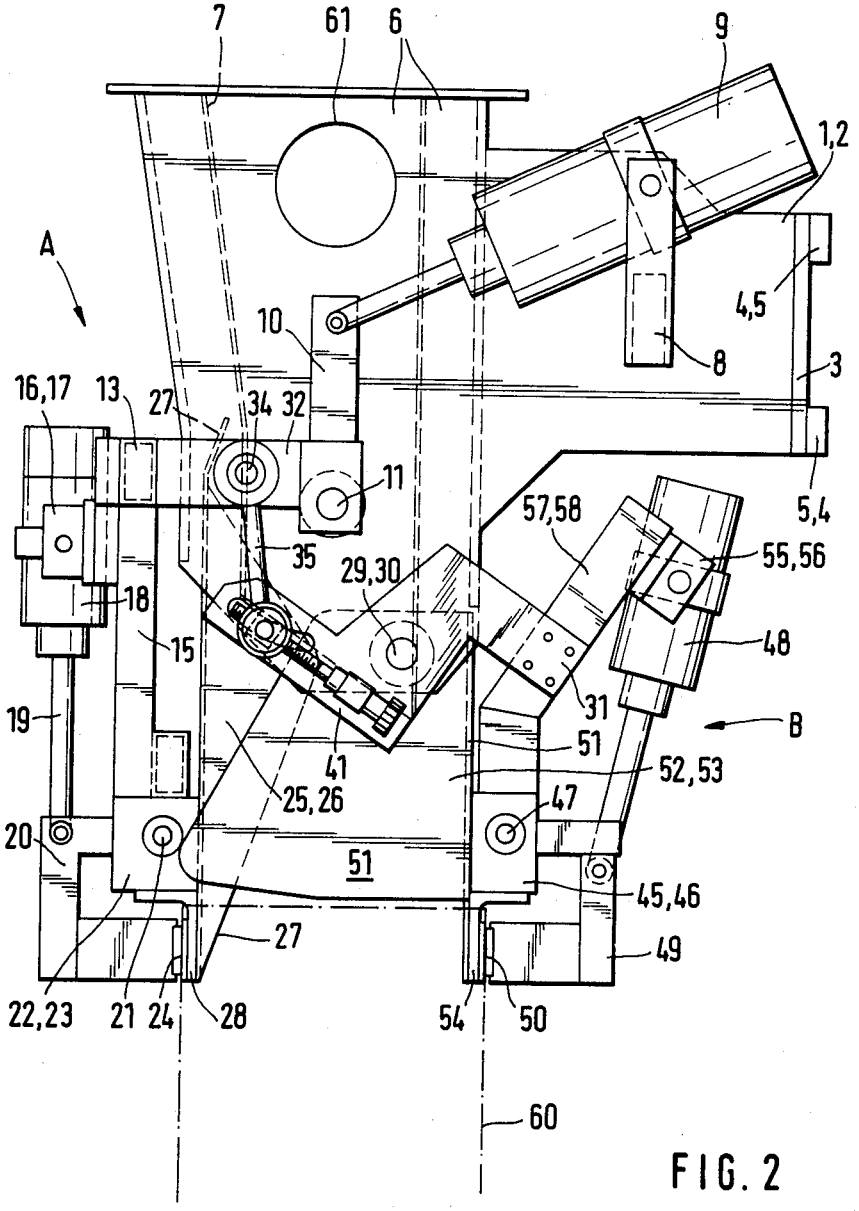
FIG. 2 is a view similar to FIG. 1 of the filling apparatus with the sack opened and swung to its filling position.
Figure 3:
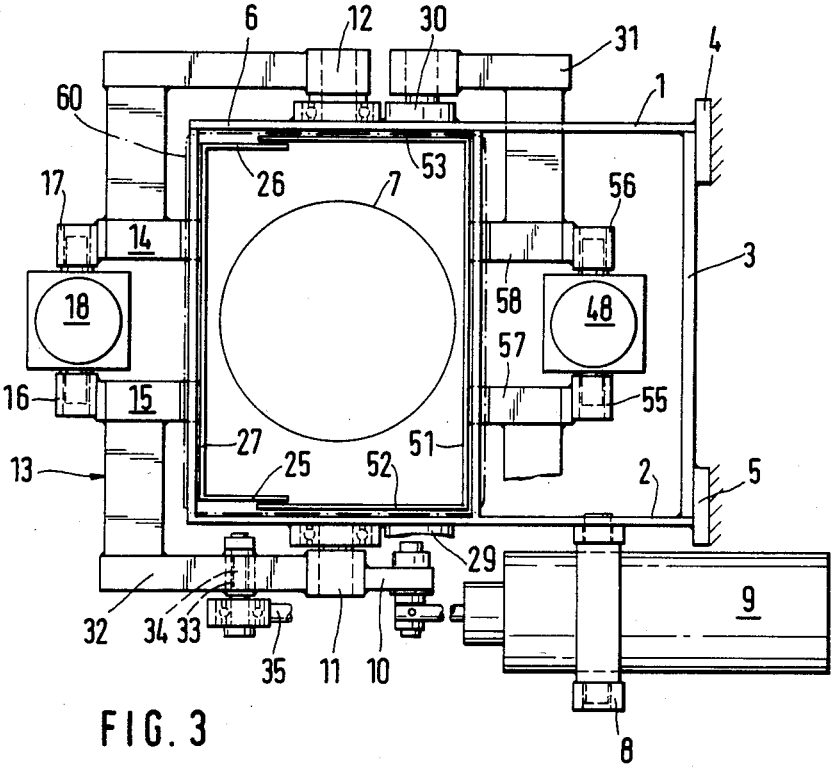
FIG. 3 is a plan view of the FIG. 2 filling apparatus.
Figure 4:
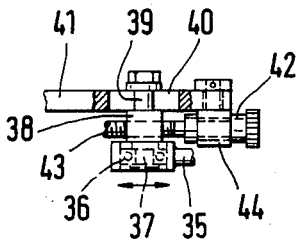
FIG. 4 is a section on the line IV—IV in FIG. 1 through a mounting adjustable in an elongate hole.

If it is desired to fill a sack of which the mouth is substantially larger than the mouth of the FIG. 2 sack, it is first also placed in position and pressed by the clamping levers 20 and 49 against the reinforcing angles 28 and 54. To ensure that the outwardly or inwardly curved side walls of the sack are held taut for ensuring the efficient removal of dust, the hand wheel 42 is moved and the flap 51 is swung about the pins 29 and 30 until the side walls of the sack that are not engaged by the clamping levers 20 and 49, and extending transversely thereto, are held taut and only then can the dust be efficiently sucked off. If the change in the mouth of the sack is excessively large, the closure flap 27 would remain in the FIG. 2 vertical position whereas the flap 51 would more or less depart from the vertical, i.e. the two flaps 27 and 51 would no longer be disposed centrally of the funnel 7. In order nevertheless to obtain a central position of the two flaps relatively to the funnel 6 or 7, the strokes length of the piston-cylinder unit 9 can also be changed during adjustment by the hand wheel 42 so that the flap 51 can be swung about the pins 29 and 30 to the same extent as the closure flap 27 is then swung about the pins 11 and 12. If the piston-cylinder unit is operated pneumatically, a change in the length of the stroke of the piston-cylinder unit 9 can, for example, be achieved by an adjustable abutment (not shown) which acts on the lever 10.

I claim:

1. Apparatus for filling sacks, said apparatus comprising: a supporting frame; a pair of opposed closure flaps which are pivotable on said frame about spaced, parallel horizontal axes, said flaps having edges spaced from the axes and including clamping means for clamping opening-defining edges of sacks to be filled; a substantially vertical filling conduit having an axis and positioned between the flaps for supplying filling material for filling the sacks, said conduit being rigid and having an opening inclined to the conduit axis and which is closed by one of said closure flaps upon pivoting of the flaps to a substantially V-shaped receiving position for a new sack; one of said closure flaps being longer than the other flap and completely covering the opening of the filling conduit when the apparatus is in a first, sack-receiving position wherein said longer flap can be pivoted to sealingly abut and cover the opening of the filling conduit when the apparatus is in the sack-receiving position; and pivoting means to pivot said closure flaps from said first, sack-receiving position to a second, sack filling position wherein said longer flap is pivoted away from the opening of the filling conduit to permit material to flow therethrough into the sack, wherein one of the closure flaps is secured to an arm of a lever means comprising part of said pivoting means and the lever means is pivoted to the frame and to one end of a piston-cylinder unit carried on said frame, and the other closure flap is secured to an arm of a second lever means comprising part of said pivoting means, coupling means to couple said second lever means to said first lever means so that said pivoting means simultaneously pivots said pair of closure flaps always in the same direction.

2. Apparatus according to claim 1, wherein a medial line between the flaps when they are swung to their first, sack-receiving position at which they are in V-shaped relationship, extends obliquely relative to the filling conduit axis.

3. Apparatus according to claim 1, wherein said coupling means includes a coupling rod having a first end displaceably securable in an elongate hole formed in said second lever means, said elongate hole being concentrically curved about the pivot axis about which said one of said closure flaps is adapted to pivot, said coupling rod having a second end pivotally carried at said pivot axis.

4. Apparatus according to claim 3, wherein an adjusting spindle is provided to displace said first end of said coupling rod relative to said elongate hole.

5. Apparatus according to claim 1, including actuator means for pivoting the first lever means, and said actuator means is adjustable to vary the degree of pivoting of said first lever means.

6. Apparatus according to claim 1, wherein the supporting frame surrounds the filling conduit and is spaced outwardly thereof to define a flow channel therebetween and the opposed flaps each include at least partially overlapping plates to define a substantially closed discharge passage.

7. Apparatus according to claim 6, wherein the supporting frame includes a cover plate extending across said flow channel above said conduit opening, and a suction aperture is provided in said supporting frame to permit dust from the filling material to be sucked from said flow channel.

8. Apparatus according to claim 6, wherein said supporting frame is of rectangular cross-section and the closure flaps when pivoted to their second, sack filling position spread over a cross-sectional area substantially corresponding to the supporting frame cross-section.

* * * * *